US007740029B2

(12) United States Patent
Hodson et al.

(10) Patent No.: US 7,740,029 B2
(45) Date of Patent: Jun. 22, 2010

(54) PAPERMAKING CLOTHING

(75) Inventors: Mark Adrian Hodson, Lancs (GB); David Holden, Lancs (GB); Bryan Gisbourne, Lancs (GB); Michael A. Gisbourne, legal representative, Preston (GB)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 11/472,767

(22) Filed: Jun. 22, 2006

(65) Prior Publication Data

US 2007/0095415 A1 May 3, 2007

(30) Foreign Application Priority Data

Jun. 25, 2005 (DE) ..... 10 2005 029 573

(51) Int. Cl.
*D21F 7/08* (2006.01)
*D03D 3/04* (2006.01)
*D03D 25/00* (2006.01)

(52) U.S. Cl. ..... 139/383 A; 139/383 AA; 139/383 R; 162/358.2

(58) Field of Classification Search ..... 139/383 A, 139/383 AA; 162/348, 358.2
See application file for complete search history.

(56) References Cited

U.S. PATENT DOCUMENTS 2,088,447 A * 7/1937 Specht ..... 245/8
3,167,281 A * 1/1965 Hill ..... 245/8
4,149,571 A * 4/1979 Burroughs ..... 139/383 A
4,244,084 A * 1/1981 Gisbourne ..... 24/33 C
4,611,639 A * 9/1986 Bugge ..... 139/383 A
4,636,426 A * 1/1987 Fleischer ..... 442/149
4,827,579 A * 5/1989 Gisbourne ..... 24/391
5,454,405 A * 10/1995 Hawes ..... 139/383 A
5,465,764 A * 11/1995 Eschmann et al. ..... 139/383 A
5,609,931 A * 3/1997 Delavallade ..... 428/36.1
5,713,398 A * 2/1998 Josef ..... 139/383 A
5,799,708 A * 9/1998 Josef ..... 139/383 A
5,944,062 A * 8/1999 Gampe ..... 139/383 A
6,001,443 A * 12/1999 Holden et al. ..... 428/61
6,123,116 A * 9/2000 Ward et al. ..... 139/383 A
6,145,550 A * 11/2000 Ward ..... 139/383 A
6,179,013 B1 * 1/2001 Gulya ..... 139/383 A
6,241,081 B1 * 6/2001 Holden ..... 198/844.2
6,332,480 B1 12/2001 Best ..... 139/383
6,451,412 B1 * 9/2002 Holden ..... 428/193
7,059,357 B2 * 6/2006 Ward ..... 139/348
2007/0095415 A1 * 5/2007 Hodson et al. ..... 139/383 A
2007/0119513 A1 * 5/2007 Hodson ..... 139/385

FOREIGN PATENT DOCUMENTS

DE 454092 12/1927
FR 1456692 9/1966

* cited by examiner

*Primary Examiner*—Bobby H Muromoto, Jr.
(74) *Attorney, Agent, or Firm*—Taylor & Aust, P.C.

(57) ABSTRACT

A papermaking fabric includes a system of warp yarns interwoven with a system of weft yarns. The system of weft yarns includes groups of weft yarns, each of the groups being formed by a plurality of adjacent weft yarns weaving in the group side-by-side the same weave path with the warp yarns. A method of manufacturing such a papermaking fabric is also provided.

18 Claims, 7 Drawing Sheets

PAPERMAKING CLOTHING

CROSS-REFERENCE TO RELATED APPLICATIONS

The present application claims priority under 37 CFR 119 of German Patent Application, the disclosure of which is expressly incorporated by reference herein in its entirety.

BACKGROUND OF THE INVENTION

1. Field of Invention

The present invention relates to papermaking fabrics for use in papermaking machines, in particular for use in the dryer section of a papermaking machine.

2. Description of Prior Art

Papermaking fabrics commonly are made by weaving weft yarns with warp yarns. During weaving on the weaving loom, the shafts together with its corresponding warp yarns are alternately lifted and lowered to enable the insertion of weft yarn shoots extending in cross direction to the warp yarns. The rate of weaving and therefore the weaving speed mainly is limited by the insertion rate of the weft yarns and the number of weft yarns in a fabric design. As the weaving is a very labour intensive manufacturing method the manufacturing costs are significantly influenced by the weaving speed and the number of weft yarns per unit of running length.

SUMMARY OF THE INVENTION

It is the object of the present invention to provide a papermaking fabric that can be fabricated faster and therefore less cost intensive to produce compared to those known in the art.

It is another object of the present invention to provide a papermaking fabric that is less sensitive to contamination as those known in the art.

It is also an object of the present invention to provide a papermaking fabric, especially a dryer fabric, having increased surface contact points or area on both sides of the fabric.

According to a first aspect of the invention there is provided a papermaking fabric having a system of warp yarns interwoven with a system of weft yarns. The papermaking fabric according to the invention is characterized in that the system of weft yarns comprise groups of weft yarns, each of the groups being formed by a plurality of adjacent weft yarns weaving in the group side-by-side the same weave path with the warp yarns.

By providing a papermaking fabric having weft yarn groups, each of which is formed by a plurality of adjacent weft yarns, wherein the adjacent weft yarns in each of the groups weave side-by-side the same weave path with warp yarns the weft yarns of each group can be inserted during weaving of the fabric at the same time. In this manner, weaving speed can be increased with the effect of faster production of the fabric at a lower cost.

Fabric designs known in the art normally provide weft yarns being separated by the interlacing of warp yarns by forming interstices, resulting in increased air permeability. By providing a plurality of adjacent weft yarns weaving side-by-side the same weave path with the warp yarns of the present invention, the number of interstices is reduced. This results in reduction of the air permeability of the fabric with the advantage of less air carriage for the application in high speed papermaking machines, especially for papermaking machines having a production speed of 1000 meter per minutes or more. Further, by forming less interstices, the fabric according to the present invention has less ability to trap contaminations coming from the paper producing process.

According to an embodiment of the present invention, it is foreseen that the system of weft yarns further comprise ungrouped weft yarns. In this manner the system of weft yarns is formed by groups of weft yarns and by ungrouped weft yarns. By way of example the system of weft yarns comprise groups of two adjacent weft yarns, the two adjacent yarns in each group weave—like a single yarn—the same weave path with the warp yarns and wherein between each group two ungrouped weft yarns are located weaving different weave paths in relation to each other.

According to another embodiment of the invention the system of weft yarns is only being formed by groups of weft yarns. In this case each of the weft yarns of a first group weave the same weave path with the warp yarns wherein the weft yarns of a second group weave the same weave path, being different to the weave path of the first group.

Depending on the specific application of the fabric the adjacent weft yarns in a group can have the same dimension. This can, for example, be the case if the paper contacting side of the fabric should be as flat as possible. A possible weave structure can be in this case an asymmetrical weave where the warp yarns float over two or more groups of weft yarns of the same dimension.

The weft yarns and/or warp yarns of the fabric according to the invention preferably have round and/or rectangular cross section and/or preferably being monofilament yarns.

For other applications it can be suitable if the adjacent weft yarns in a group have different dimensions. This is especially the case when different weft yarns in a group have to fulfill different functions.

In addition it is possible that the adjacent weft yarns in a group have the same composition or that they have different compositions. The later case can again be feasible if different yarns in the group have to fulfill different functions, for example, a first of them needs to have hydrophobic properties, whereas a second of them needs to have enhanced abrasion resistance properties.

For dryer fabrics application according to a preferred embodiment of the present invention, the system of warp yarns is interwoven with the system of weft yarns in a single-layer weave.

According to another preferred embodiment of the present invention the warp yarns alternately weave over and under the groups of weft yarns, wherein adjacent warp yarns do not weave side-by-side over or under the same group of weft yarns.

In this manner, the weave structure of the fabric according to the invention is a plain weave in the sense that each of the groups of weft yarns is regarded as being a single yarn.

This embodiment is especially advantageous for the application of the fabric as a dryer fabric in a paper making machine operating at a machine speed of about 1000 m/min omr more or 1200 m/min or more. For such high speed machines often a single tier dryer configuration is used. In this configuration vacuum rolls and stabiliser boxes are provided to produce under pressure to hold the paper web against the fabric surface to improve tail threading and sheet runnability.

By providing a weave structure with warp yarns which alternately weave over and under the groups of weft yarns, wherein adjacent warp yarns do not weave side-by-side over or under the same group of weft yarns, a discontinuous surface on at least the paper contacting side of the fabric is generated. This discontinuous fabric surface has straight channels in weft direction, being in most cases of application the cross machine direction, which are connected by channels formed between warp yarns which weave over the groups of weft yarns. These channels form a channel matrix. The channel matrix allows the formation of an under pressure network between the paper side of the fabric and the paper, thereby increasing the sheet runnability.

Further the weave structure according to this preferred embodiment provides an improved bending stiffness in weft direction, which is in many cases the cross machine direction (CD-direction) of the fabric in the paper making machine, compared to fabrics known in the art. The increased bending stiffness in CD-direction reduces the tendency of the fabric for edge curl and therefore improves the runnability of the fabric.

Additionally, the preferred weave structure provides reduced contamination affinity at the same time as the fabric can be cleaned more easily compared to fabrics known in the art.

It is understood that if the fabric of the invention has grouped weft yarns as well as ungrouped weft yarns, the warp yarns alternately weave over and under the groups of weft yarns and the ungrouped weft yarns, wherein adjacent warp yarns do not weave side-by-side over or under the same group of weft yarns and the same ungrouped weft yarns (as can be seen for example in FIG. 3).

The single-layer weave further can be one of a broken twill weave, a straight twill weave, and a matt weave. It is also possible to have combinations of the before mentioned weave designs.

For further reduction of the permeability of the fabric on the one hand and for further reduction of the contamination affinity according to a preferred embodiment of the present invention it is foreseen that said warp system comprise groups of warp yarns, each of the groups being formed by a plurality of adjacent warp yarns weaving in the group side-by-side the same weave path with said weft yarns. By way of example the weft system can be formed of groups of two adjacent weft yarns weaving the same weave path and the warp system can be formed of groups of four adjacent warp yarns weaving the same weave path.

According to a preferred embodiment it is foreseen that the groups of warp yarns alternately weave over and under the groups of weft yarns, wherein adjacent groups of warp yarns do not weave side-by-side over or under the same group of weft yarns.

The advantages set out in the above discussion where single warp yarns alternately weave over and under the groups of weft yarns are fully applicable for this embodiment and will therefore be no further point of discussion.

Preferably the fabric according to the present invention is woven flat. In this case at least some of the warp yarns form seaming loops or hold a spiral or other means at the lengthwise ends of the papermaking fabric so that it can be joined endless. In the case that the fabric according to the invention is woven flat the weft yarns extend along the intended CD direction in the papermaking machine and the warp yarns extend along the intended MD direction in the paper making machine.

The fabric according to the invention is suitable for use in the different sections of the papermaking machine. Therefore the papermaking fabric can be a forming fabric or a press fabric or a dryer fabric.

According to a second aspect of the present invention a paper making machine comprising a dryer section is provided, wherein the dryer section is a single tier dryer section comprising a dryer fabric according to the invention. The most benefit of the fabric according to the present invention in terms of sheet runnability can be achieved if the paper making machine is one that operates at a machine speed at about or greater than 1200 m/min or more.

According to a third aspect of the present invention a highly productive and cost saving method of manufacturing a papermaking fabric with a woven structure being formed by weaving of weft yarns with warp yarns comprising the step of inserting a plurality of weft yarns at the same time by one weft shoot such that said plurality of weft yarns weave side-by-side the same weave path with said warp yarns is provided.

BRIEF DESCRIPTION OF THE DRAWINGS

The present invention is further described in the detailed description which follows, in reference to the noted drawing by way of non-limiting example of exemplary embodiment of the present invention, and wherein.

DETAILED DESCRIPTION OF THE PRESENT INVENTION

The particulars shown herein are by way of example and for purposed of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
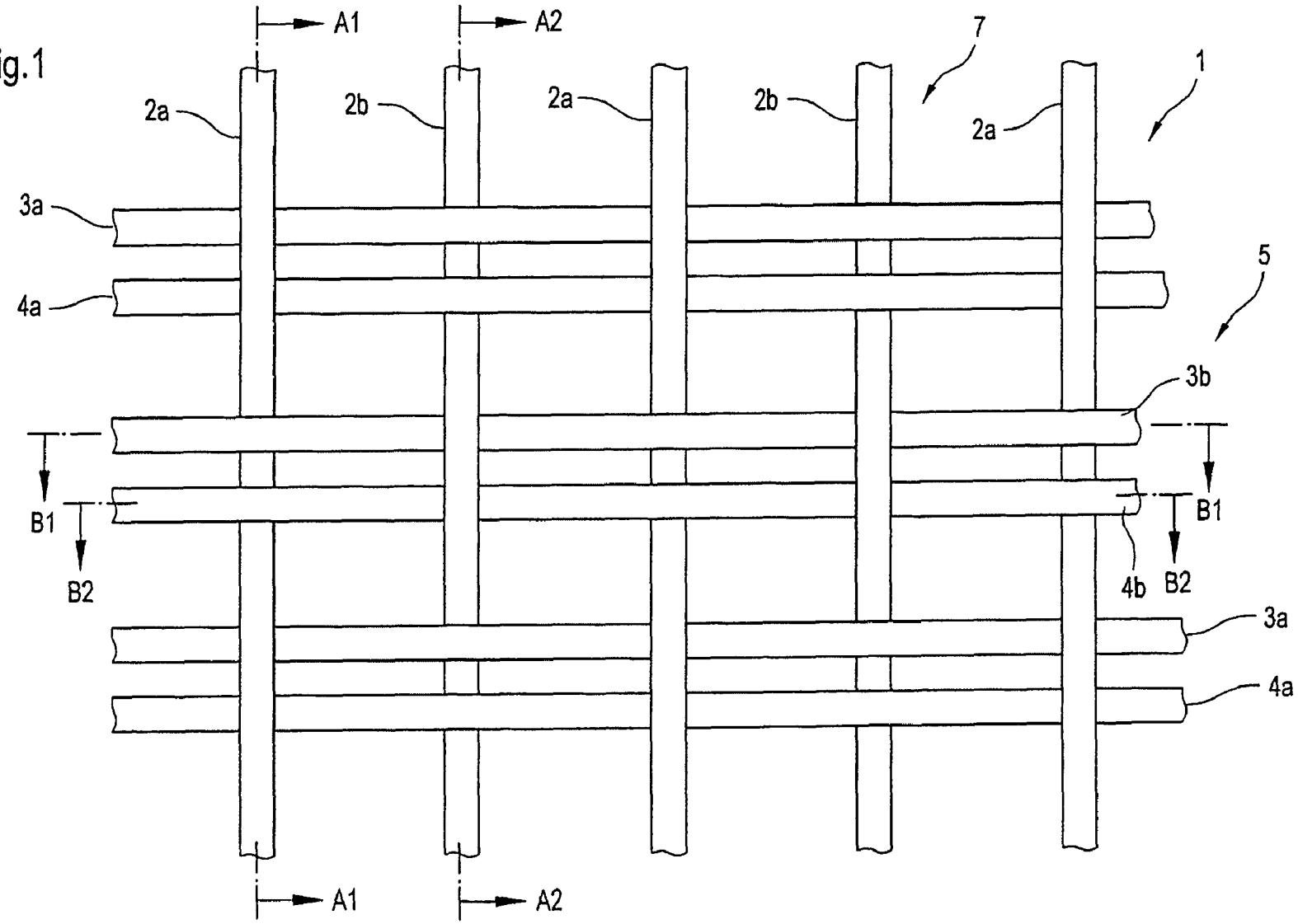
FIG. 1 shows a top view of a first embodiment of a papermaking fabric according to the present invention.

In FIG. 1, the dryer fabric 1 is woven as a single-layer fabric comprising a warp yarn system 7 with warp yarns 2*a*, 2*b* and a weft yarn system 5 with weft yarns 3*a*, 3*b*, 4*a*, 4*b*. As can be seen according to the invention weft yarns 3*a*, 3*b*, 4*a*, 4*b* are arranged in groups of two adjacent weft yarns 3*a*, 4*a* and 3*b*, 4*b*, weaving in said group side-by-side the same weave path with said warp yarns 2*a*, 2*b*.

Fabric 1 is repeated by weave repeat units being formed by the warp yarns 2*a*, 2*b* and the weft yarns 3*a*, 4*a*, 3*b*, 4*b*.

As can be seen the weft yarn system 5 is only formed by said groups 3*a*, 4*a* and 3*b*, 4*b* of weft yarns.

The single-layer weave shown in FIG. 1 is a plain weave, in the sense that each of the groups 3*a*, 4*a* and 3*b*, 4*b* has to be regarded like a single yarn.

FIG. 2*a* shows a cross sectional view of the dryer fabric of FIG. 1 along the cutting line A1-A1 showing the weave path of warp yarn 2*a*. Warp yarn 2*a* alternating weaves over and under adjacent groups of weft yarns 3*a*, 4*a* and 3*b*, 4*b*. As can be seen all weft yarns 3*a*, 3*b*, 4*a*, 4*b* have the same dimension and have circular cross section. In the embodiment shown further weft yarns 3*a*, 3*b*, 4*a*, 4*b* have the same composition.

FIG. 2*b* shows a cross sectional view of the dryer fabric of FIG. 1 along the cutting line A2-A2 showing the weave path of warp yarn 2*b*. Warp yarn 2*b* alternating weaves over and under adjacent groups of weft yarns 3*a*, 4*a* and 3*b*, 4*b*. By comparison of FIGS. 2*a* and 2*b* it can be seen, that the adjacent warp yarns 2*a* and 2*b* do not weave side-by-side over and under the same group of weft yarns.

By way of example warp yarn 2*a* weave over weft yarn group 3*a*, 4*a* and under weft yarn group 3*b*, 4*b* wherein adjacent warp yarn 2*b* weaves under weft yarn group 3*a*, 4*a* and over weft yarn group 3*b*, 4*b*.

FIG. 2*c* shows a cross sectional view of the dryer fabric of FIG. 1 along the cutting line B1-B1 showing the weave path of weft yarn 3*b*, wherein FIG. 2*d* shows a cross sectional view of the dryer fabric of FIG. 1 along the cutting line B2-B2 showing the weave path of weft yarn 4*b*. Weft yarn 3*b* alternating weaves over and under adjacent warp yarns 2*a*, 2*b*. According to the invention the other weft yarn 4*b* (shown in FIG. 2*d*) of said weft yarn group weave the same weave path over and under the warp yarns 2*a*, 2*b*. As can be seen all warp yarns 2*a*, 2*b* have the same dimension and have circular cross section. In the embodiment shown further weft yarns 3*a*, 3*b*, 4*a*, 4*b* have the same composition.

Figure 2:
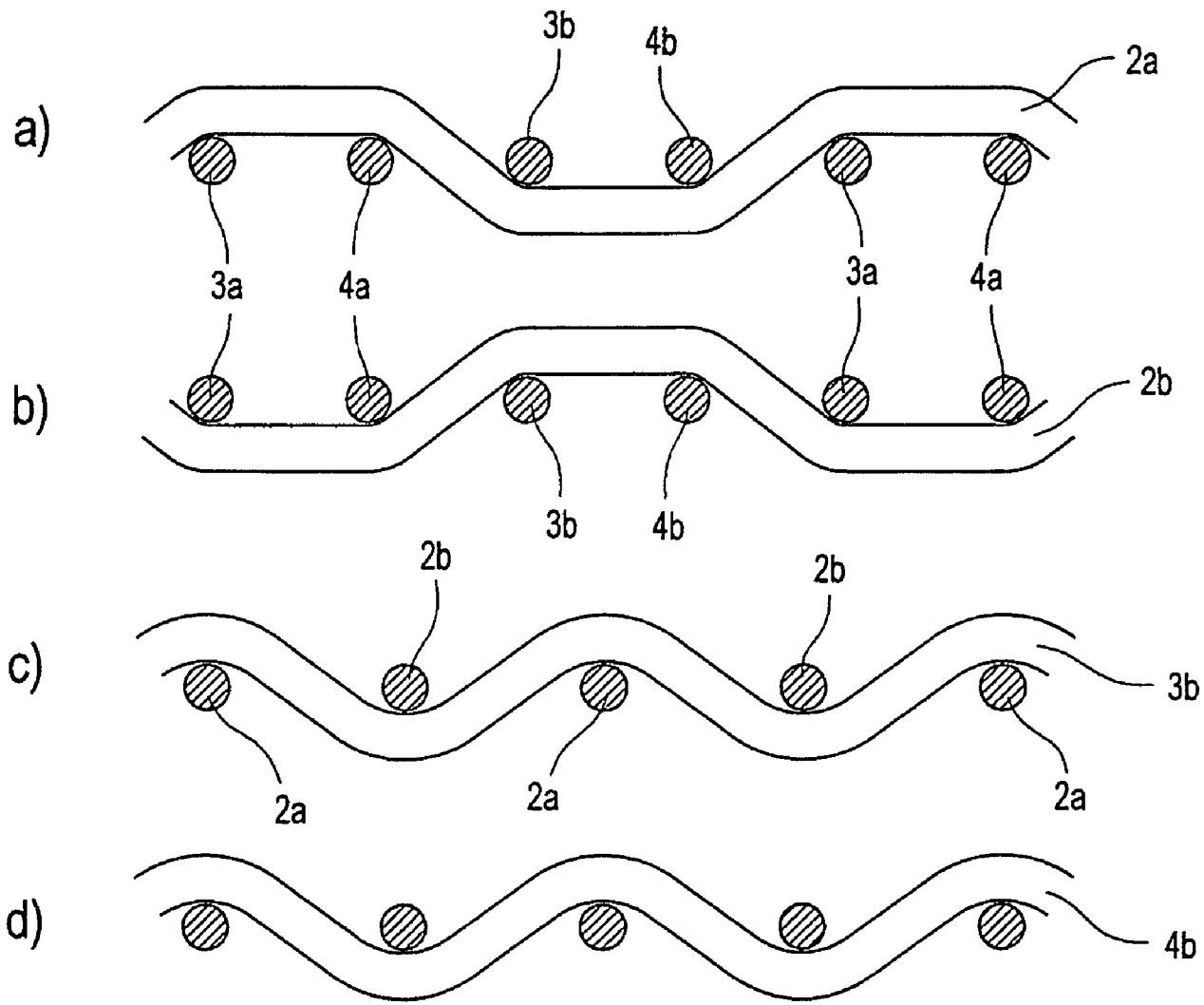
FIG. 2A shows cross sectional views along cuttings A1-A1 of the fabric of FIG. 1.
FIG. 2B shows cross sectional views along cuttings A2-A2 of the fabric of FIG. 1.
FIG. 2C shows cross sectional views along cuttings B1-B1 of the fabric of FIG. 1.
FIG. 2D shows cross sectional views along cuttings B2-B2 of the fabric of FIG. 1.

The spacing between the yarns shown in FIGS. 1 and 2 is greatly expanded for the sake of clarity. In reality the yarns can be woven much more tightly to provide a papermaking fabric having an air permeability of less than 300 cfm (cubic feet per minute per square foot).

Further adjacent weft and/or warp yarns can also be equally spaced.

To increase planarity of the paper contacting surface of the dryer fabric 1, to decrease air permeability and to decrease contamination affinity it further could be advantageous to provide at least some of the weft or warp yarns with a flat cross section, e.g. with a rectangular cross section having an aspect ratio of width to height of 2:1, preferably 5:1, most preferably of 10:1.

Figure 3:
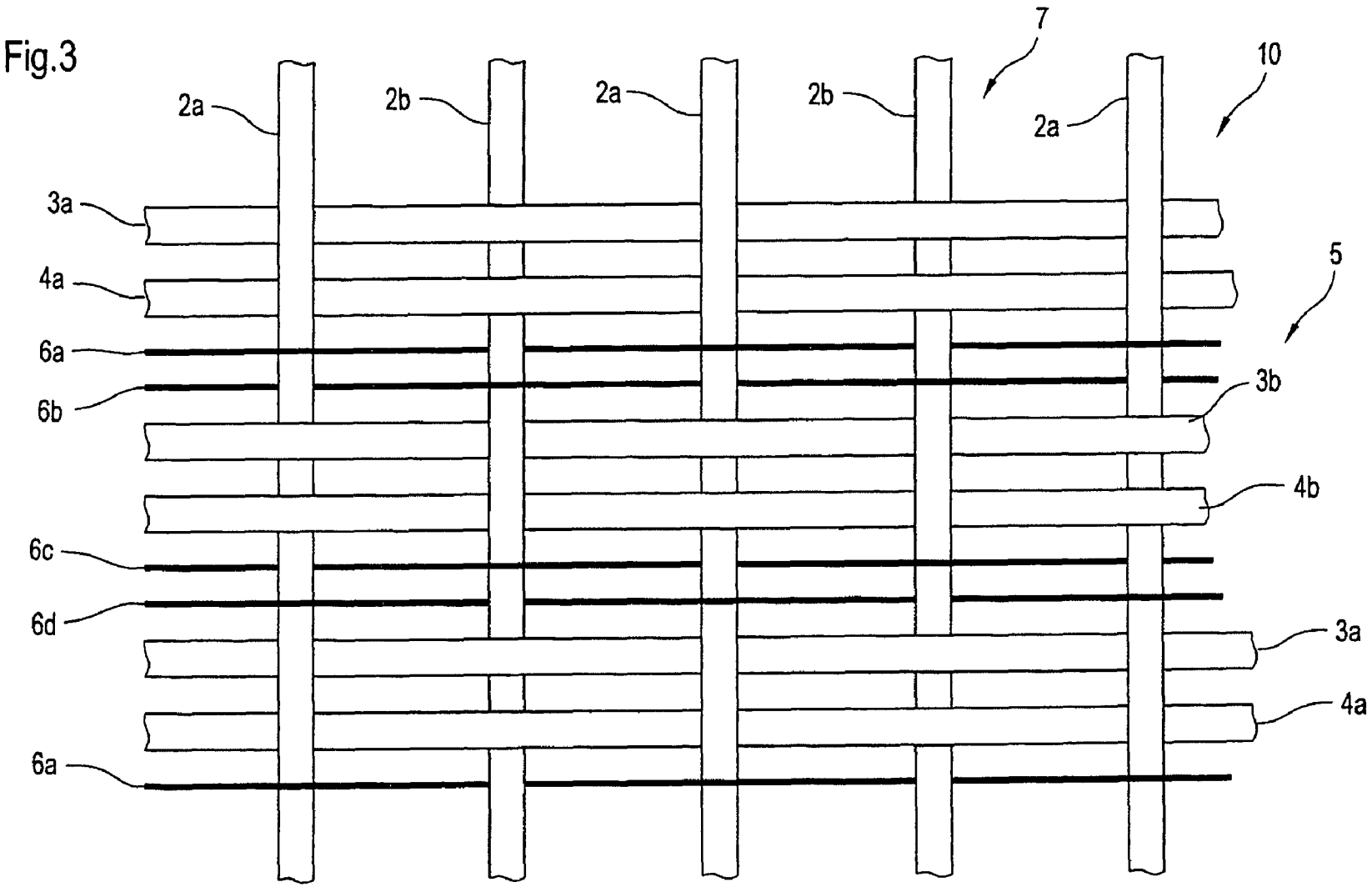
FIG. 3 shows a top view of a second embodiment of a papermaking fabric according to the present invention.

FIG. 3 shows in part a top view of a papermaking fabric 10 according to the present invention. The papermaking fabric 10 is a dryer fabric for use in a dryer section of a papermaking machine. Note that features being the same as disclosed in FIG. 1 are indicated with the same reference numbers.

The dryer fabric 10 is woven as a single-layer fabric has a warp yarn system 7 with warp yarns 2*a*, 2*b* and a weft yarn system 5 with weft yarns 3*a*, 3*b*, 3*a*, 4*a*, 4*b* and 6*a*, 6*b*, 6*c*, 6*d*. As can be seen according to the invention weft yarns 3*a*, 3*b*, 4*a*, 4*b* are arranged in groups of two adjacent weft yarns 3*a*, 4*a*and 3*b*, 4*b* weaving in said group side-by-side the same weave path with said warp yarns 2*a*, 2*b*.

In contrast to the dryer fabric 1 shown in FIG. 1, dryer fabric 10 comprises between the groups of weft yarns 3*a*, 4*a* and 3*b*, 4*b* ungrouped weft yarns 6*a*, 6*b*, 6*c*, 6*d*. In contrast to the weft yarns 3*a*, 4*a*, 3*b*, 4*b* adjacent ungrouped weft yarns 6*a*, 6*b*, 6*c*, 6*d* weave different weave paths with the warp yarns 2*a*, 2*b*. By way of example ungrouped weft yarn 6*a* weaves over warp yarns 2*a* and under warp yarns 2*b* whereas adjacent ungrouped weft yarn 6*b* weaves over warp yarns 2*b* and under warp yarns 2*a*.

Accordingly, the weft yarn system 5 is formed by said groups 3*a*, 4*a* and 3*b*, 4*b* of weft yarns and by ungrouped weft yarns 6*a*, 6*b*, 6*c*, 6*d*.

As can be seen the warp yarns 2*a*, 2*b* alternately weave over and under the groups of weft yarns 3*a*,4*a* and 3*b*,4*b* and the ungrouped weft yarns 6*a* to 6*d*, wherein adjacent warp yarns 2*a*, 2*b* do not weave side-by-side over or under the same group of weft yarns e.g. 3*a*,4*a* and the same ungrouped weft yarns e.g. 6*a*.

Accordingly, the single-layer weave shown in FIG. 3 is a plain weave, in the sense that each of the groups of weft yarns has to be regarded like a single yarn.

Fabric 10 is repeated by weave repeat units being formed by the warp yarns 2*a*, 2*b* and the weft yarns 3*a*, 4*a*, 3*b*, 4*b*, 6*a* to 6*d*.

The spacing between the yarns shown in FIG. 3 is greatly expanded for the sake of clarity. In reality the yarns can be woven much more tightly to provide a papermaking fabric having an air permeability of less than about 300 cfm (cubic feet per minute per square foot).

To increase planarity of the paper contacting surface of the dryer fabric 10, to decrease air permeability and to decrease contamination affinity it further could be advantageous to provide at least some of the weft or warp yarns with a flat cross section, e.g. with a rectangular cross section having an aspect ratio of width to height of 2:1, preferably 5:1, most preferably of 10:1.

Figure 4:
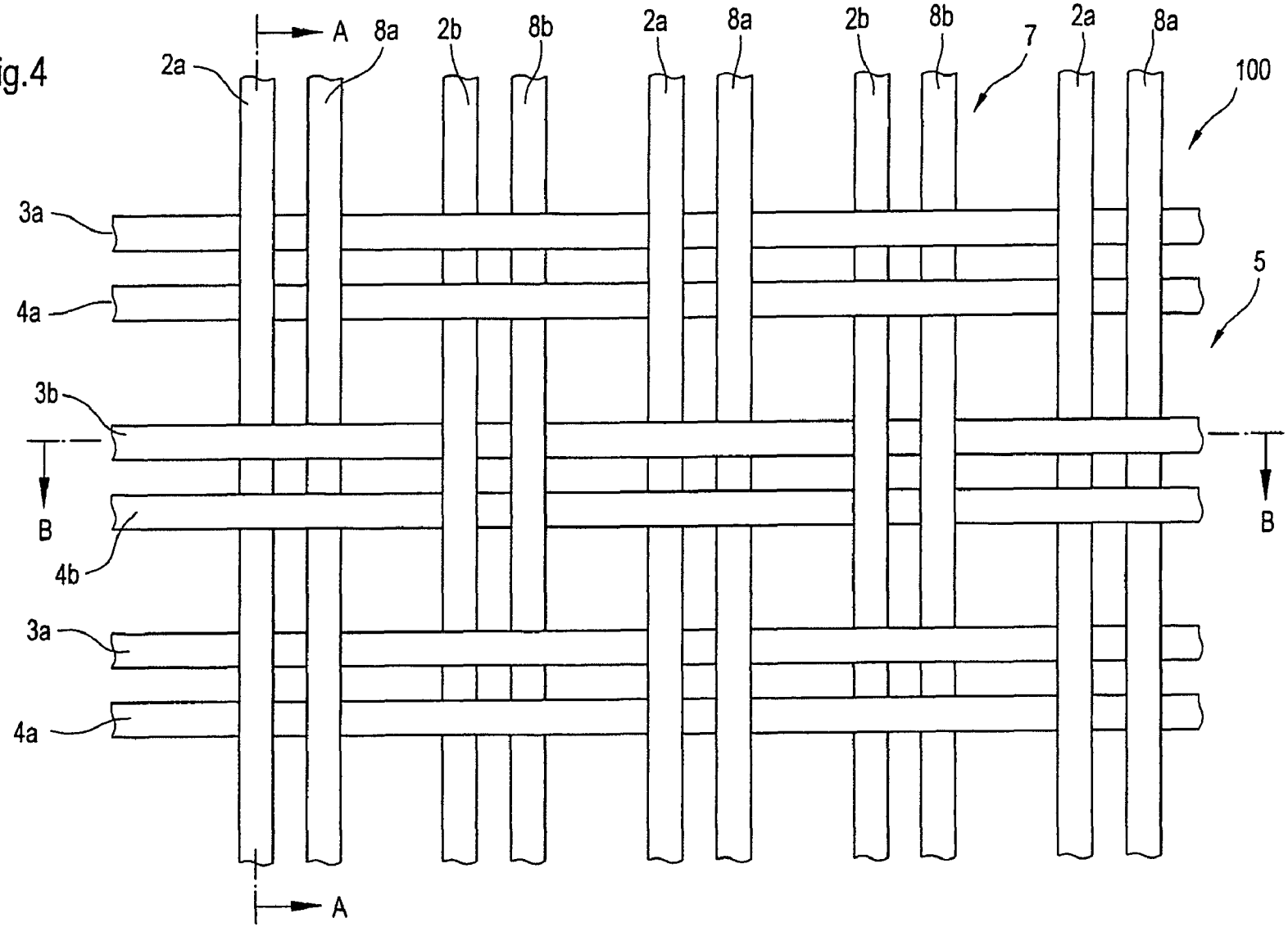
FIG. 4 shows a top view of a third embodiment of a papermaking fabric according to the present invention.

FIG. 4 shows in part a top view of a papermaking fabric 100 according to the present invention. The papermaking fabric 100 is a dryer fabric for use in a dryer section of a papermaking machine. Note that features being the same as disclosed in FIGS. 1, 2 and 3 are indicated with the same reference numbers.

The dryer fabric 100 is woven as a single-layer fabric having a warp yarn system 7 with warp yarns 2*a*, 2*b*, 8*a*, 8*b* and a weft yarn system 5 with weft yarns 3*a*, 3*b*, 4*a*, 4*b*. As can be seen according to the invention weft yarns 3*a*, 3*b*, 4*a*, 4*b* are arranged in groups of two adjacent weft yarns 3*a*, 4*a* and 3*b*, 4*b*, weaving in said group side-by-side the same weave path with said warp yarns 2*a*, 2*b*, 8*a*, 8*b*.

In contrast to the dryer fabric 1 and 10 shown in FIGS. 1, 2 and 3 the warp yarn system 7 of dryer fabric 100 has groups of two adjacent warp yarns 2*a*, 8*a* and 2*b*, 8*b* weaving in said group side-by-side the same weave path with the groups of weft yarns 3*a*, 4*a* and 3*b*, 4*b*.

FIG. 5*a* shows a cross sectional view of the dryer fabric 100 of FIG. 4 along the cutting line A-A showing the weave path of warp yarn 2*a*. Warp yarn 2*a* weaves alternating over and under adjacent groups of weft yarns 3*a*, 4*a* and 3*b*, 4*b*. As can be seen all weft yarns 3*a*, 3*b*, 4*a*, 4*b* have the same dimension and have rectangular cross section with a width to height ratio in the range of greater than 1:1 up to 10:1. In the embodiment shown further weft yarns 3*a*, 3*b*, 4*a*, 4*b*, have the same composition.

FIG. 5*b* shows a cross sectional view of the dryer fabric of FIG. 4 along the cutting line B-B showing the weave path of warp yarn 3*b*. Warp yarn 3*b* weaves alternating over and under adjacent warp yarn groups being formed of adjacent warp yarns 2*a*, 8*a* and 2*b*, 8*b*. According to the invention the other weft yarn 4*b* (not shown) of said weft yarn group weave the same weave path over and under the groups of warp yarns 2*a*, 8*a* and 2*b*, 8*b*. As can be seen all warp yarns 2*a*, 2*b*, 8*a*, 8*b* of the warp yarn system 7 have the same dimension and have rectangular cross section. In the embodiment shown further weft yarns 3*a*, 3*b*, 4*a*, 4*b* have the same composition.

Fabric 100 is repeated by weave repeat units being formed by the warp yarns 2*a*, 2*b*, 8*a*, 8*b* and the weft yarns 3*a*, 4*a*, 3*b*, 4*b*.

Figure 5:
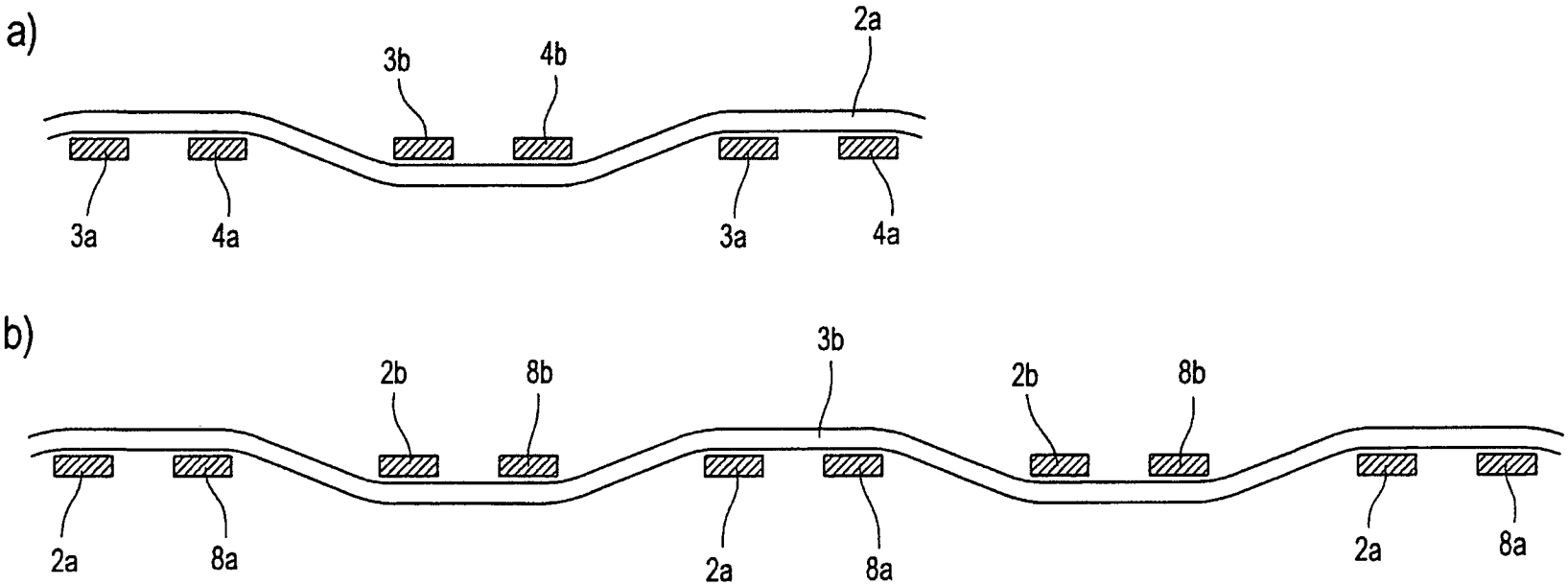
FIG. 5A shows cross sectional views along cuttings A-A of the fabric of FIG. 4.
FIG. 5B shows cross sectional views along cuttings B-B of the fabric of FIG. 4, FIGS. 6A-6D show cross sectional views in warp yarn direction of a further papermaking fabric according to the present invention.

The spacing between the yarns shown in FIGS. 4 and 5 is greatly expanded for the sake of clarity. In reality the yarns can be woven much more tightly to provide a papermaking fabric having an air permeability of less than about 300 cfm (cubic feet per minute per square foot).

Further adjacent weft and/or warp yarns can be equally spaced.

The fabrics 1, 10 100 shown in the FIGS. 1 to 5 preferably are woven flat. Therefore at least some of the warp yarns of the warp yarn system 7 form seaming loops at the lengthwise ends of the papermaking fabric 1, 10, 100 so that it can be joined endless.

Further the weft and/or warp yarns of the weft yarn system 5 and/or the warp yarn system 7 are preferably monofilament yarns.

Figure 6:
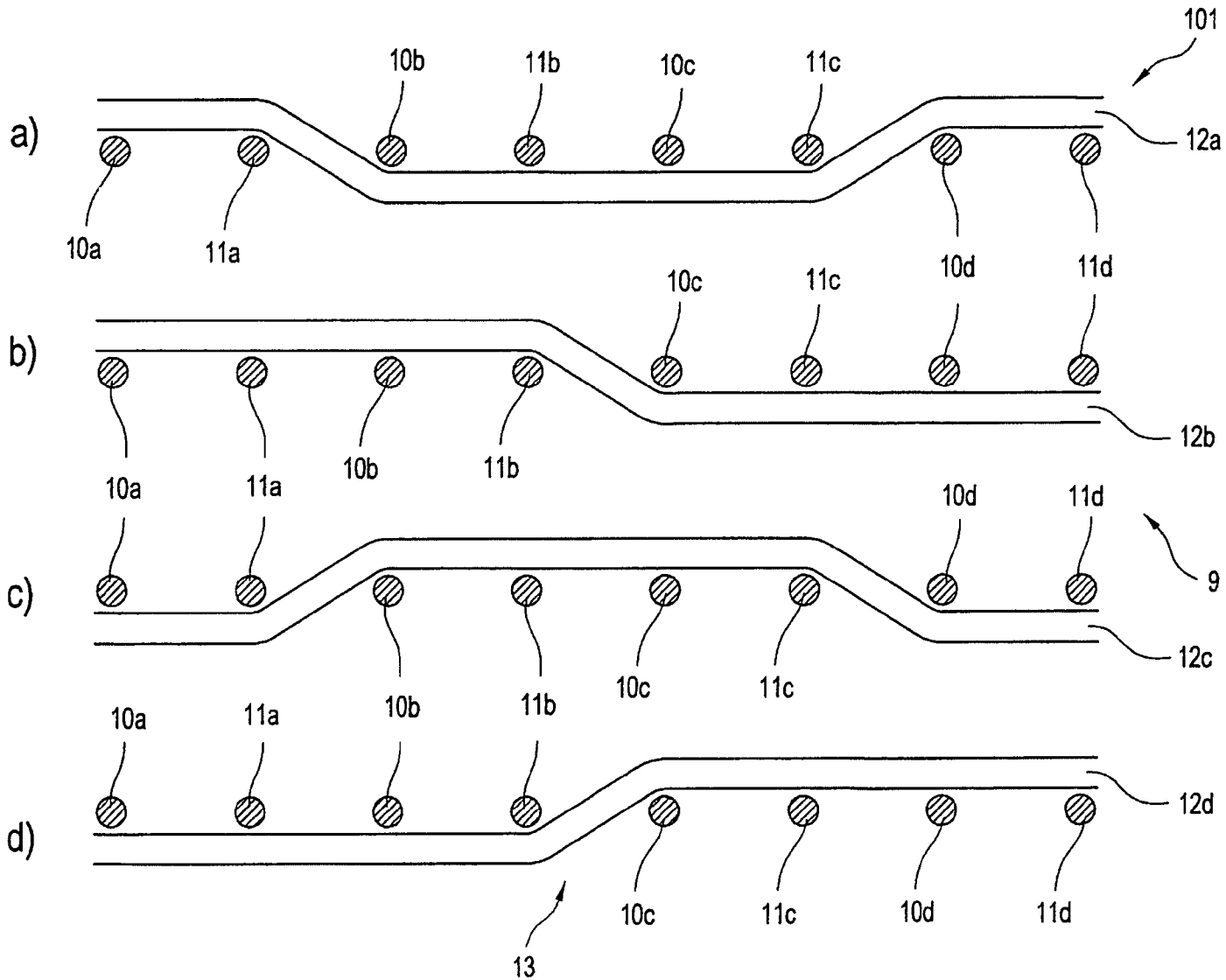

FIG. 6 shows cross sectional views in warp yarn direction of a further papermaking fabric 101 according to the present invention. In FIGS. 6*a* to 6*d* the full weave repeat of fabric 101 is shown. As can be seen fabric 101 is a single-layer straight twill weave. Fabric 101 has a warp yarn system 9 having warp yarns 12*a*, 12*b*, 12*c*, 12*d* and a weft yarn system 13 having weft yarns 10*a*, 10*b*, 10*c*, 10*d*, 11*a*, 11*b*, 11*c*, 11*d* arranged in groups of two adjacent weft yarns 10*a*, 11*a* and 10*b*, 11*b* and 10*c*, 11*c* and 10*d*, 11*d* weaving in each of the groups side-by-side the same weave path with the warp yarns 12*a* to 12*d*.

Figure 7:
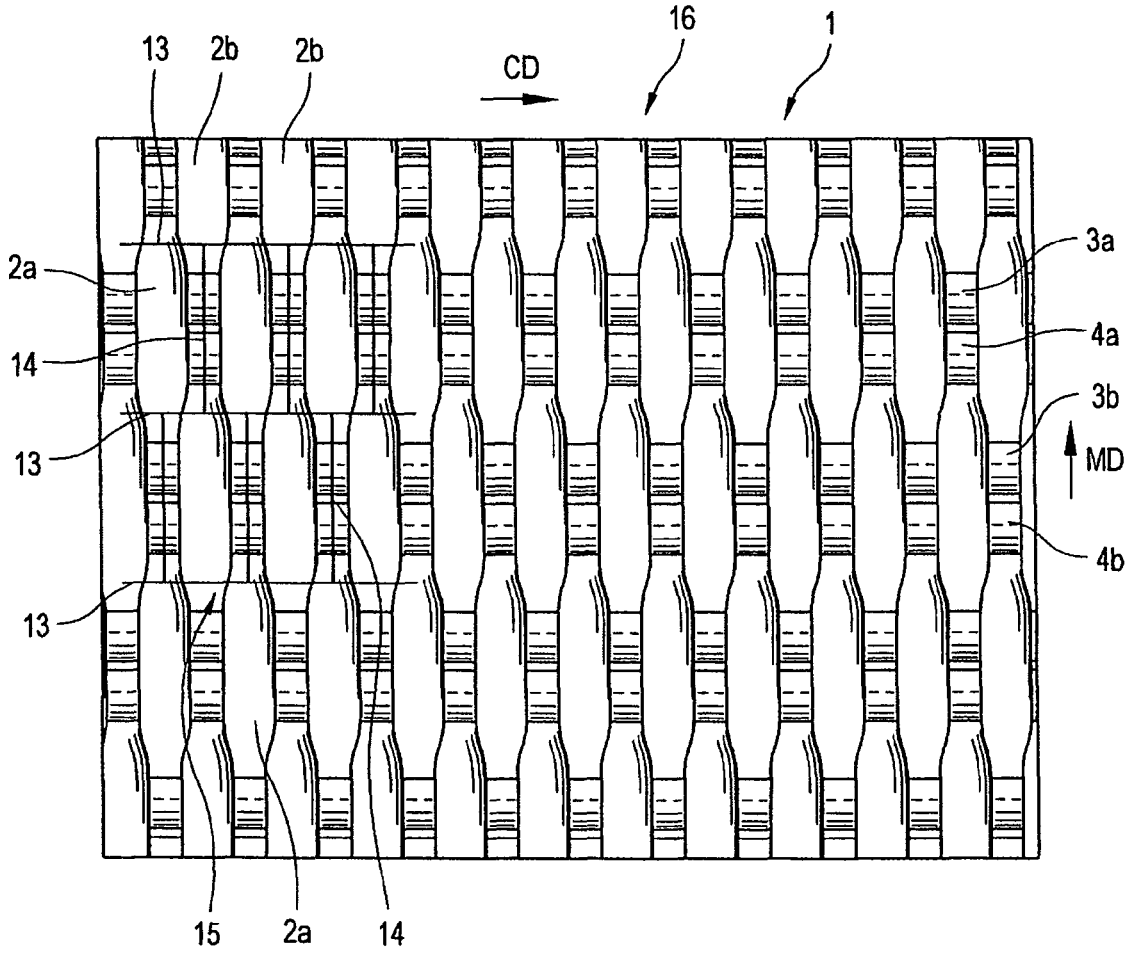
FIG. 7 shows a plain view of the paper side of the dryer fabric shown in FIGS. 1 and 2.

FIG. 7 shows a plain view of the paper side 16 of the dryer fabric 1 as already discussed in FIGS. 1 and 2.

As can be seen all the warp yarns 2*a*, 2*b* alternately weave over and under the groups of weft yarns 3*a*, 4*a* and 3*b*, 4*b*. Further it can be seen that the adjacent warp yarns 2*a* and 2*b* do not weave side-by-side over or under the same group of weft yarns 3*a*, 4*a* or the same group of weft yarns 3*b*,4*b*. Therefore the weave structure of the fabric 1 can be regarded as a plain weave in the sense that each of the groups 3*a*, 4*a* and 3*b*, 4*b* weaves side-by-side like a single yarn.

Further it can be seen that a discontinuous surface on the paper contacting side 16 of the fabric 1 is generated. This discontinuous fabric surface 16 has straight channels 13 in weft- or cross machine direction (CD-direction), which are connected by channels 14 formed between warp yarns 2*a* which weave over the groups of weft yarns 3*a*, 4*a*. The channels 13 and 14 form a channel matrix 15. These channel matrix 15 allows the formation of an under pressure network between the paper side 16 of the fabric 1 and the paper and thereby increasing the sheet runnability.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A papermaking fabric, comprising:

a system of warp yarns interwoven with a system of weft yarns, wherein the system of weft yarns further comprises a plurality of groups of weft yarns and a plurality of ungrouped weft yarns, each of said groups formed by a plurality of adjacent weft yarns weaving in said group side-by-side the same weave path with said warp yarns, the papermaking fabric being a dryer fabric, said plurality of ungrouped weft yarns including, between each of said groups of weft yarns, a plurality of adjacent weft yarns which weave different weave paths relative to one another with said warp yarns.

2. The papermaking fabric according to claim 1, wherein the adjacent weft yarns in each group have the same dimension.

3. The papermaking fabric according to claim 1, wherein the adjacent weft yarns in each group have different dimensions.

4. The papermaking fabric according to claim 1, wherein the adjacent weft yarns in each group have the same composition.

5. The papermaking fabric according to clam 1, wherein the adjacent weft yarns in each group have different compositions.

6. The papermaking fabric according to claim 1, wherein the warp yarns alternately weave over and under said groups of weft yarns, wherein adjacent warp yarns do not weave side-by-side over or under the same group of weft yarns.

7. The papermaking fabric according to claim 1, wherein the system of warp yarns is interwoven with said system of weft yarns in a single-layer weave.

8. The papermaking fabric according to claim 7, wherein the single-layer weave is one of a broken twill weave, a straight twill weave, and a matt weave.

9. The papermaking fabric according to claim 1, wherein the warp system further comprises groups of warp yarns, each of said groups being formed by a plurality of adjacent warp yarns weaving in said group side-by-side the same weave path with said weft yarns.

10. The papermaking fabric according to claim 9, wherein the groups of warp yarns alternately weave over and under said groups of weft yarns, and wherein adjacent groups of warp yarns do not weave side-by-side over or under the same group of weft yarns.

11. The papermaking fabric according to claim 1, wherein at least some of said warp yarns form one of seaming loops and hold a spiral at the lengthwise ends of the papermaking fabric so that the fabric can be joined endless with a pin seam.

12. The papermaking fabric according to claim 1, wherein the system of weft yarns further comprises weft yarns having at least one of round and rectangular cross section.

13. The papermaking fabric according to claim 1, wherein the system of warp yarns further comprises warp yarns having at least one of round and rectangular cross section.

14. The papermaking fabric according to claim 1, wherein at least one of the weft and warp yarns are monofilament yarns.

15. The papermaking fabric according to claim 1, wherein the weft yarns extend along the intended CD direction in the papermaking machine and the warp yarns extend along the intended MD direction in the paper making machine.

16. A papermaking machine comprising a dryer section, wherein the dryer section is a single tier dryer section comprising a dryer fabric, said dryer fabric comprising a system of warp yarns interwoven with a system of weft yarns, wherein the system of weft yarns further comprises a plurality of groups of weft yarns and a plurality of ungrouped weft yarns, each of said groups formed by a plurality of adjacent weft yarns weaving in said group side-by-side the same weave path with said warp yarns, said plurality of ungrouped weft yarns including, between each of said groups of weft yarns, a plurality of adjacent weft yarns which weave different weave paths relative to one another with said warp yarns.

17. The papermaking machine according to claim 16, wherein the machine operates at a machine speed of about or greater than 1200 m/min or more.

18. A method of manufacturing a papermaking fabric with a woven structure by weaving of weft yarns with warp yarns comprising the steps of:

inserting a plurality of ungrouped weft yarns, said plurality of ungrouped weft yarns including a plurality of adjacent weft yarns which weave different weave paths relative to one another with said warp yarns;

inserting a first plurality of weft yarns at the same time by one weft yarn shoot such that said first plurality of weft yarns weave side-by-side the same weave path with said warp yarns and thereby form a first group of weft yarns; and inserting a second plurality of weft yarns at the same time by one weft yarn shoot such that said second plurality of weft yarns weave side-by-side the same weave path with said warp yarns and thereby form a second group of weft yarns, said plurality of ungrouped weft yarns being between said first and second groups of weft yarns, the papermaking fabric being a dryer fabric.

* * * * *